US008521043B2

(12) United States Patent
Nakano et al.

(10) Patent No.: US 8,521,043 B2
(45) Date of Patent: Aug. 27, 2013

(54) IMAGE FORMING APPARATUS HAVING A WASTE TONER CONTAINER

(75) Inventors: Hiroshi Nakano, Nagoya (JP); Hirotaka Mori, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1045 days.

(21) Appl. No.: 11/944,063

(22) Filed: Nov. 21, 2007

(65) Prior Publication Data

US 2008/0124157 A1 May 29, 2008

(30) Foreign Application Priority Data

Nov. 24, 2006 (JP) ..... 2006-317138

(51) Int. Cl.
*G03G 21/12* (2006.01)
*G03G 15/16* (2006.01)

(52) U.S. Cl.
USPC ..... 399/35; 399/101

(58) Field of Classification Search
USPC ..... 399/35, 358, 360, 359, 257, 101
See application file for complete search history.

(56) References Cited

U.S. PATENT DOCUMENTS 4,579,252 A * 4/1986 Wilson et al.
4,739,370 A 4/1988 Yoshida et al.
5,138,394 A * 8/1992 Watanabe et al. ..... 399/360
5,614,996 A 3/1997 Tanda
5,848,342 A * 12/1998 Tanda ..... 399/358
6,157,807 A * 12/2000 Takenouchi et al. ..... 399/358
6,941,101 B2 * 9/2005 Kato
7,016,639 B2 3/2006 Park et al.
2005/0220515 A1 * 10/2005 Wakana ..... 399/358
2007/0230991 A1 * 10/2007 Sato

FOREIGN PATENT DOCUMENTS

JP 60055354 A * 3/1985
JP 60-107677 A 6/1985
JP 60-250379 A 12/1985
JP 62-217278 A 9/1987
JP 62-244081 A 10/1987
JP 1-088966 U 6/1989
JP 3103468 U 10/1991
JP 4-045474 A 2/1992
JP 05072952 A * 3/1993
JP 5-341697 A 12/1993
JP 6-194997 A 7/1994
JP 07104631 A * 4/1995
JP 8-062919 A 3/1996
JP 9-068901 A 3/1997

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming apparatus is configured to form an image on a recording sheet by transferring toner onto the recording sheet. The image forming apparatus may include a container having an inlet configured to receive waste toner, the container defining a storage area having a horizontal dimension greater than a vertical dimension. Also, the image forming apparatus may include a first pump disposed adjacent to the inlet of the container on an inlet side, the first pump configured to feed waste toner from the inlet to an outlet side of the first pump, and a second pump disposed adjacent to the outlet side of the first pump, the second pump configured to feed the waste toner fed by the first pump to an outlet side of the second pump on a side opposite the inlet in the storage area.

20 Claims, 3 Drawing Sheets

(56) References Cited

FOREIGN PATENT DOCUMENTS

| | | | |
|---|---|---|---|
| JP | 11249400 A | * | 9/1999 |
| JP | 2003-241596 A | | 8/2003 |
| JP | 2005-010751 A | | 1/2005 |
| JP | 2005-173350 A | | 6/2005 |

* cited by examiner

IMAGE FORMING APPARATUS HAVING A WASTE TONER CONTAINER

CROSS REFERENCE TO RELATED APPLICATION

This application claims priority from Japanese Patent Application No. 2006-317138, filed on Nov. 24, 2006, the entire subject matter of which is incorporated herein by reference.

FIELD

Aspects described herein relate to an electrophotographic image forming apparatus, such as a laser printer.

BACKGROUND

Electrophotographic image forming apparatuses such as laser printers are generally configured to form an image on a recording medium such as a sheet of paper or a transparency (hereinafter referred to as a recording sheet) by transferring a developing agent or toner. However, some of the toner to be supplied may remain on a photosensitive drum or a conveyor belt, and become waste.

If printing or image formation is performed with waste toner remaining on the conveyor belt, the waste toner adhering to the conveyor belt may be unintentionally transferred onto a backside of a recording sheet causing an undesired image to be formed on the backside of the recording sheet.

To prevent recording sheets from being printed with undesired images, some image forming apparatuses are provided with a waste toner container. The waste toner container is configured to collect and accommodate or hold waste toner.

To increase capacity of the waste toner container, the volume of the waste toner container should be increased. However, if the volume of the waste toner container increases by increasing its height dimension, the image forming apparatus will increase in height.

If the volume of the waste toner container increases in the length dimension, a current pump for conveying waste toner can experience difficulty in conveying the waste toner to the back of the waste toner container. Much waste toner may accumulate at the entrance of the waste toner container, making it difficult for the container to hold a sufficient amount of waste toner if the volume of the container increases.

The capability of conveying can be improved by increasing the size of the pump for conveying waste toner. However, this may result in increasing the size of the image forming apparatus and the pump.

SUMMARY

Aspects described herein may provide an image forming apparatus including a waste toner container configured to accommodate or hold a sufficient amount of waste toner by increasing a volume of the container in a horizontal size or length dimension.

BRIEF DESCRIPTION OF THE DRAWINGS

Features herein will be described in detail with reference to the following figures in which like elements are labeled with like numbers and in which.

DETAILED DESCRIPTION

A first illustrative embodiment of the invention will be described in detail with reference to the accompanying drawings. The image forming apparatus features described herein may be applied to an electrophotographic image forming apparatus, such as a laser printer. It will be appreciated that aspects of the invention apply to other types of image forming apparatuses as well.

An appearance of a laser printer 1 will be now described with reference to FIG. 1.

Figure 1:
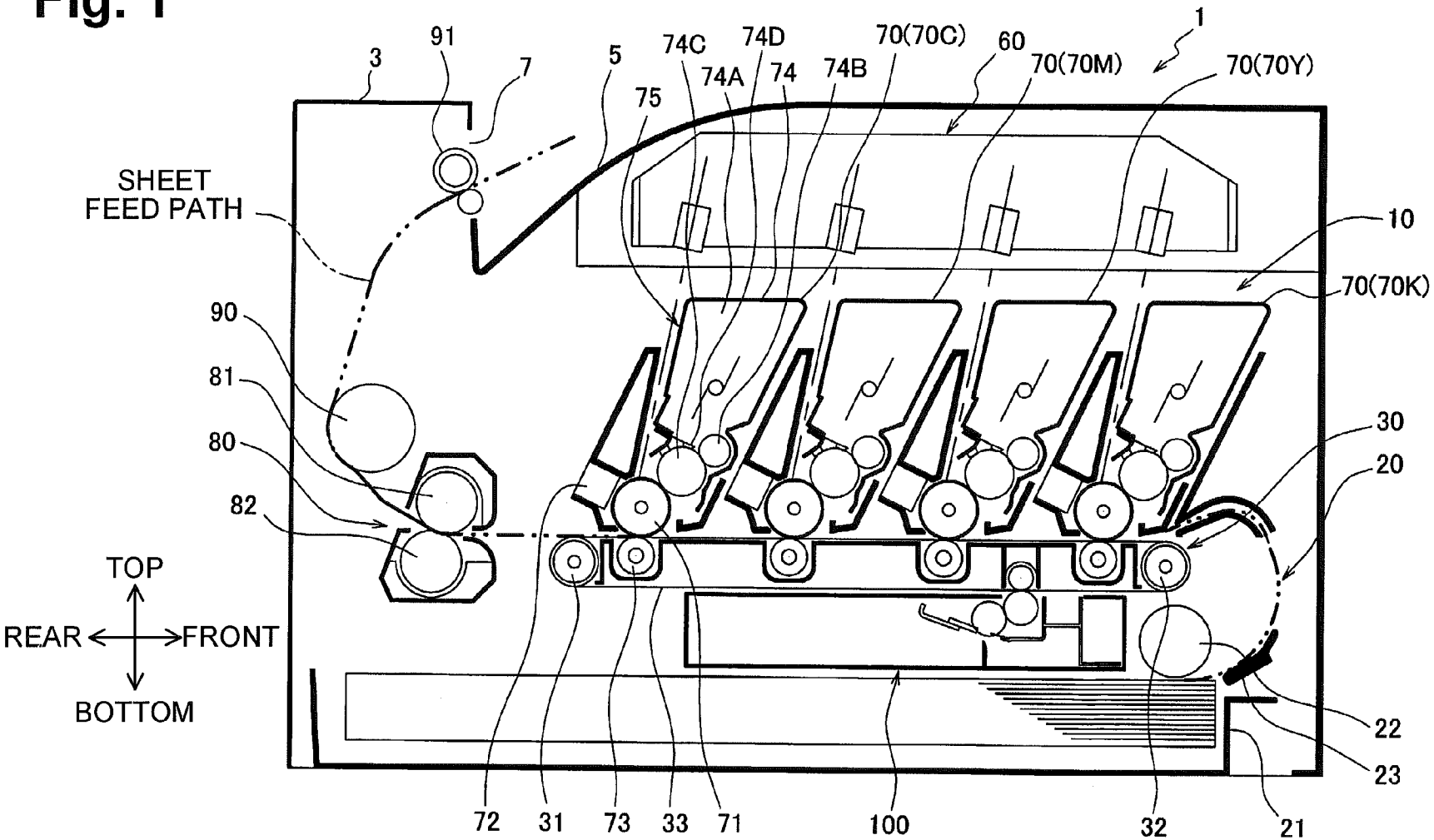
FIG. 1 is a side sectional view showing a main part of a laser printer according to an illustrative embodiment.

An upper side of FIG. 1 is referred to as the top of the laser printer 1, and the right side of FIG. 1 is referred to as the front side of the laser printer 1. In the following description, top, bottom, rear, and front of objects in the laser printer 1 are used with reference to the arrows in FIG. 1.

A housing 3 provides for an apparatus body of the laser printer 1. A sheet discharge tray 5 may be provided on the top of the housing 3. Printed recording sheets such as plain paper or transparencies may be ejected from the housing 3 and received on the sheet discharge tray 5.

An apparatus frame member (not shown) made of metal or resin may be provided in the housing 3, and a developing cartridge 70 and a fixing unit 80 may be coupled to the apparatus frame member in a detachable manner.

An internal structure of the laser printer 1 will be described.

The laser printer 1 may include an image forming portion 10, a feeder portion 20, and a feed mechanism 30. The image forming portion 10 is configured to form an image onto a recording sheet. The feeder portion 20 may function as a part of a feeding device configured to supply a recording sheet to the image forming portion 10. The feed mechanism 30 may be configured to feed a recording sheet to four developing cartridges 70K, 70Y, 70M, 70C included in the image forming portion 10.

After an image has been recorded on the recording sheet, an intermediate feed roller 90 and an ejection chute (not shown) may feed the recording sheet upwards towards ejection rollers 91. The ejection rollers 91 may cause the sheet to be ejected from the ejection portion 7 and onto the ejection tray 5.

The feeder portion 20 may include a sheet supply tray 21, a sheet supply roller 22, and a separation pad 23. The sheet supply tray 21 may be disposed in the lowermost part of the housing 3, and may be configured to hold a stack of recording sheets. The sheet supply roller 22 may be disposed at an upper front end of the sheet supply tray 21, and may be configured to supply or feed a recording sheet from the sheet supply tray 21 to the image forming portion 10. The separation pad 23 may be disposed downstream of the sheet supply roller 22 in the direction of the roller's rotation, and may be configured to apply a resistance to separate a topmost sheet from the stack of recording sheets in the sheet supply tray 21.

The recording sheet stored in the sheet supply tray 21 makes a u-turn (e.g., is flipped over) at the front side of the housing 3, and is conveyed to the image forming portion 10, which may be centrally disposed in the housing 3.

The feed mechanism 30 may include a drive roller 31, a driven roller 32, and a conveyor belt 33. The drive roller 31 may be configured to rotate along with an operation in the image forming portion 10. The driven roller 32 may be spaced away from the drive roller 31 and may be configured to rotate. The conveyor belt 33 may be stretched between the drive roller 31 and the driven roller 32.

As the conveyor belt 33 rotates with a recording sheet placed thereon, the recording sheet supplied from the sheet supply tray 21 can be conveyed to the four developing cartridges 70K, 70Y, 70M, and 70C successively.

A belt cleaner 100 will be described in detail. The belt cleaner 100 is attached to the apparatus frame member in a detachable manner. The belt cleaner 100 is configured to remove toner adhering to a surface of the conveyor belt 33.

A cleaning roller 101 is configured to remove toner adhering to the surface of the conveyor belt 33. A cleaning shaft 102 is configured to feed toner adhering to a surface of the cleaning roller 101 to a waste toner container 105.

The cleaning roller 101 rotates in an opposite direction to a rotational direction D1 of the conveyor belt 33, in contact with the conveyor belt 33, thereby scraping toner off the conveyor belt 33.

The cleaning shaft 102 is subjected to application of an electrical charge having a polarity, e.g. a negative charge in this illustrative embodiment, opposite to an electrical charge of toner. The cleaning shaft 102 rotates in contact with an outer surface of the cleaning roller 101 to remove waste toner from the cleaning roller 101.

Waste toner adhering to the surface of the cleaning shaft 102 during transfer is scraped off by a blade 103 and then conveyed to the waste toner container 105 by a first pump 110.

A scattering prevention blade 104 is configured to prevent waste toner scraped off from the cleaning shaft 102 from scattering toward the cleaning roller 101. The scattering prevention blade 104 may include a flexible thin film. The scattering prevention blade 104 can be fixed at one end to an inner wall of the casing 108, and slidable on the outer surface of the cleaning shaft 102 at the other end.

The waste toner container 105 defines a storage area 106 in which waste toner can be stored. The storage area 106 may be defined as a thin flat shape such that a length L is greater than a height H.

Figure 2A:
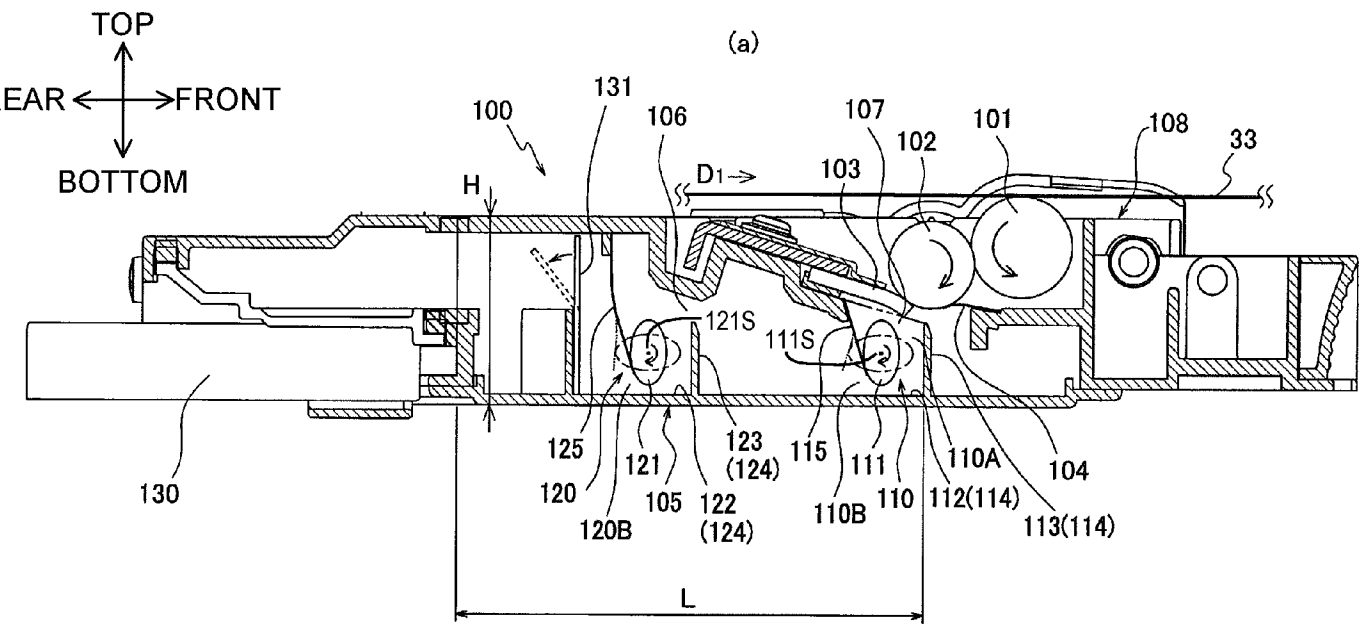
FIG. 2A is an enlarged view of a belt cleaner according to a first illustrative embodiment.
Figure 2B:
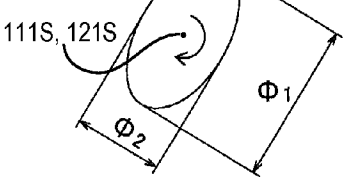
FIG. 2B is an enlarged view of an elliptical rotor.

The waste toner container 105 includes a toner inlet 107 at an end, e.g. at the front. An inlet side 110A of the first pump 110 is disposed adjacent to a toner inlet 107. The first pump 110 is configured to convey waste toner toward the storage area 106. A second pump 120 is disposed on an outlet side 110B of the first pump 110 in the waste toner container 105. The second pump 120 is configured to convey the waste toner conveyed by the first pump 110 further into the storage area 106. As illustrated in FIG. 2A, the second elliptical rotor 121 is disposed closer to the bottom peripheral surface of the container 105 than to the top peripheral surface of the container 105.

The first pump 110 and the second pump 120 can be the same-type of volumetric pump. The structure of the first pump 110, taken as an example, will be described below.

The first pump 110 may include an elliptical rotor 111, a rotor housing portion 114, and a reed valve 115. The elliptical rotor 111 is configured to discharge waste toner, which is scraped off to the inlet side 110A of the first pump 110 by the blade 103, toward the outlet side 10B by rotating. The rotor housing portion 114 is provided so as to enclose the elliptical rotor 111. The reed valve 115 is configured to prevent waste toner conveyed in the storage area 106 from being ejected toward the inlet side 110A.

The elliptical rotor 111 has an elliptical shape in cross section, and is configured to rotate on a rotation shaft 111S that is perpendicular to the cross section. The rotor housing portion 114 is defined by a first wall surface 112 that extend horizontally from the outlet side 110B of the first pump 110, and a second wall surface 113 that is continuous with the first wall surface 112 and extends to the inlet side 110A in a direction perpendicular to the first wall surface 112.

The reed valve 115 can be a thin and flexible member. The reed valve 115 can be configured to slidably contact an outer surface of the elliptical rotor 111 on the outlet side 110B with respect to a center of rotation of the elliptical rotor 111.

With this structure, when a force directed outward from the inside of the storage area 106 acts on the reed valve 115, the force acting on the reed valve 115 increases a pressure exerted on a contact surface between the reed valve 115 and the elliptical rotor 111.

Thus, even when the pressure in the storage area 106 increases due to waste toner conveyed thereto and the force directed to open the reed valve 115 acts on the reed valve 115, the elliptical rotor 111 prevents the reed valve 115 from being deformed in a direction to open the reed valve 115. The reed valve 115 can maintain its closed state against the pressure in the storage area 106. Thus, if the pressure in the storage area 106 increases, waste toner will not leak outside of the storage area 106 in such a manner as to flow back unless the reed valve 115 moves over the elliptical rotor 111 and opens.

The second pump 120 may include an elliptical rotor 121; a rotor housing portion 124 defined by wall surfaces 122, lower wall surface 123, and an upper wall surface extending from the top peripheral surface of the container 105 and facing the lower wall (e.g., lower wall surface 123); and a reed valve 125. As illustrated in FIG. 2A, a lower wall (e.g., lower wall surface 123) is disposed closer to the second elliptical rotor 121 than to the first elliptical rotor 111.

The elliptical rotor 111 of the first pump 110 and the elliptical rotor 121 of the second pump 120 each have a major axis $\phi 1$ and minor axis $\phi 2$, which are identical in size.

The elliptical rotor 121 of the second pump 120 is set such that a rotational speed per unit time is greater than that of the elliptical rotor 111 of the first pump 110. Thus, the amount of feeding by the second pump 120 per unit time is greater than that of the first pump 110.

The elliptical rotor 111 of the first pump 110 and the elliptical rotor 121 of the second pump 120 are configured to rotate by drive force from a common driving source, e.g., an electric motor, not shown. The rotational speeds of the elliptical rotors 111, 121 of the first and second pump 110, 120 are adjusted according to transmission gear ratios of gears and transmission belts that transmit driving force from the driving source to the elliptical rotors 111, 121.

The cleaning roller 101 and the cleaning shaft 102 are also configured to rotate via a gear train or gearbox by the common driving source that drives the elliptical rotors 111, 121.

A toner amount detector, e.g., a waste toner level sensor 130, is disposed in the back of the waste toner container 105 (storage area 106) horizontally and on an outlet side 120B of the second pump 120. The waste toner level sensor 130 is configured to determine whether waste toner in the storage area 106 reaches a predetermined amount. The waste toner level sensor 130 may be configured to issue a signal when a switch (not shown) is actuated in response to the compression of waste toner accumulated in the storage area 106.

A film door 131 is disposed close to the second pump 120 relative to the waste toner level sensor 130. The film door 131 is thin and flexible, and is configured to partition the storage area 106 into the second pump 120 side and the waste toner level sensor 130 side. The film door 131 is configured to open when the pressure of the waste toner accumulated in the storage area 106 reaches a predetermined amount.

In this illustrative embodiment, the waste toner level sensor 130 does not operate only when the storage area 106 is filled with waste toner. The waste toner level sensor 130 is activated when the waste toner is compressed in the storage area 106 and the internal pressure reaches a predetermined amount.

When the waste toner level sensor 130 is activated and a signal is issued, an electronic controller (not shown) that controls the image forming portion 10, the feeder portion 20, and the feed mechanism 30, informs a user that image formation or the printing process can not be continued because the waste toner container 105 has become full of waste toner and the waste toner need to be discarded.

The image forming portion 10 may include a scanner unit 60, the developing cartridges 70, and the fixing unit 80.

The image forming portion 10 may be a direct-tandem type, where color printing is possible. The four developing cartridges 70K, 70Y, 70M, and 70C may correspond to four color types of toner, such as black, yellow, magenta, and cyan, respectively, and may be arranged in a line along a sheet feeding direction.

The scanner unit 60 may be disposed in an upper portion of the housing 3, and may be configured to form electrostatic latent images on corresponding surfaces of photosensitive drums (image carriers) 71 disposed in the four developing cartridges 70K, 70Y, 70M, and 70C, respectively. The scanner unit 60 may include a laser light source, a polygon mirror, fθ lens and reflecting mirrors.

A laser beam emitted from the laser light source, based on image data, may be deflected by the polygon mirror, pass through the fθ lenses, and be folded by the reflecting mirror to be directed to a surface of the photosensitive drum 71, on which an electrical latent image is formed.

The four developing cartridges 70K, 70Y, 70M, and 70C may be identical in structure, but with different colors of toner. Thus, in the following description, the structure of the developing cartridges will be described by using the developing cartridge 70C as an example.

As shown in FIG. 1, the developing cartridge 70C is detachably disposed under the scanner portion 60 in the housing 3. The developing cartridge 70C may include a photosensitive drum 71, a charger 72, and a toner storing portion 74 in a casing 75.

A transfer roller 73 may be rotatably supported by the apparatus frame member so as to face the photosensitive drum 71 on the opposing side of the conveyor belt 33.

The photosensitive drum 71 may be configured to carry an image that is to be transferred onto a recording sheet. The photosensitive drum 71 may be cylindrically shaped, and its outermost layer may be a positively charged photosensitive layer made from polycarbonate.

The charger 72 may be configured to charge the surface of the photosensitive drum 71. The charger 72 may be disposed away from the photosensitive drum 71, so as to face the photosensitive drum 71 diagonally rearward from above.

The charger 72 according to this illustrative embodiment may be a scorotron charger that charges the surface of the photosensitive drum 71 substantially uniformly and positively by corona discharge from a charging wire made of tungsten or the like.

The transfer roller 73 may be disposed to face the photosensitive drum 71, and may be configured to rotate along with the rotation of the conveyor belt 33. Also, the transfer roller 73 may be configured to apply an electrical charge, having a polarity (a negative charge in this illustrative embodiment) opposite to an electrical charge of the photosensitive drum 71, to the recording sheet from the bottom side (opposite the print surface) of the recording sheet as it passes through the photosensitive drum 71, thereby transferring toner adhering on the surface of the photosensitive drum 71 to the printed surface of the recording sheet.

The toner storing portion 74 may include a toner chamber 74A, a toner supply roller 74B, and a developer roller 74C. Toner may be stored in the toner chamber 74A. The toner supply roller 74B and the developer roller 74C may be configured to supply toner to the photosensitive drum 71.

Toner stored in the toner chamber 74A may be supplied to the developer roller 74C along with the rotation of the toner supply roller 74B. The toner supplied to the developer roller 74C may be carried on a surface of the developer roller 74C, regulated to a uniform thickness by a layer thickness regulating blade 74D, and then supplied to the surface of the photosensitive drum 71 that is exposed to light by the scanner unit 60.

The fixing unit 80 may be disposed rearward from the photosensitive drum 71 with respect to the sheet feeding direction, and may be configured to melt toner transferred onto the recording sheet by heat and fix it to the recording sheet. The fixing unit 80 may be removable from the body frame.

The fixing unit 80 may include a heat roller 81 and a pressure roller 82. The heat roller 81 may be disposed to face the print surface of a recording sheet, and may be configured to give a feeding force to a recording sheet while heating the toner on the recording sheet. The pressure roller 82 may be disposed to face the heat roller 81 from below, and may be configured to press against the heat roller 81.

In the image forming portion 10, an image may be formed on a recording sheet as follows.

As the photosensitive drum 71 rotates, the surface of the photosensitive drum 71 may be charged uniformly and positively by the charger 72, and then exposed to a laser beam emitted from the scanner portion 60 at high speed scanning. In this manner, an electrostatic latent image corresponding to the image to be formed on a recording sheet may be formed on the surface of the photosensitive drum 71.

With the rotation of the developer roller 74C, toner carried on the developer roller 74C and positively charged makes contact with the photosensitive drum 71, and is supplied to the electrostatic latent image formed on the surface of the photosensitive drum 71. The toner may be supplied to the uniformly and positively charged surface of the photosensitive drum 71 at a portion where the potential has become low due to exposure to the laser beam. As a result, the latent image on the photosensitive drum 71 becomes visible and a reversal takes place. Thus, a toner image may be formed on the photosensitive drum 71.

The toner image carried on the photosensitive drum 71 may be transferred onto the recording sheet by a transfer bias applied to the transfer roller 73. Then, the recording sheet may be conveyed and heated by the fixing unit 80 so that the toner transferred onto the recording sheet as the toner image is fixed on the recording sheet, and image formation is finished.

In this illustrative embodiment, the second pump 120 for feeding waste toner further inward in the storage area 106 is disposed on the outlet side 110B of the first pump 110. Thus, the waste toner conveyed in the storage area 106 by the first pump 110 is conveyed further inward by the second pump 120.

In this manner, the first pump 110 and the second pump 120 prevent accumulation of a large amount of waste toner in the vicinity of the first pump 110 in the storage area 106, so that plenty of waste toner can be collected in the waste toner container 105. Thus, the frequency of discarding waste toner collected in the waste toner container 105 can be reduced, the maintainability of the laser printer 1 can be improved, and the laser printer 1 can be prevented from increasing in height.

The waste toner level sensor 130 is configured to detect whether the waste toner collected in the storage area 106 reaches a predetermined amount. The waste toner level sensor 130 can be configured to detect waste toner level in the back of the storage area 106.

However, if a pump for feeding waste toner is provided only at the toner inlet 107, a large amount of waste toner can build up at the toner inlet 107. As a result, waste toner can spill out of the toner inlet 107. Alternatively, if the waste toner level sensor 130 does not detect that waste toner amount exceeds the predetermined amount and the waste toner builds up at the toner inlet 107, the build up can cause the pump to stop operating.

In this illustrative embodiment, the waste toner level sensor 130 detects the amount of waste toner collected in the storage area 106 at the outlet side 120B of the second pump 120. Thus, the waste toner level sensor 130 can detect the amount of waste toner collected in the storage area 106 so that the occurrences of failures (e.g., the pump stopping) can be reduced adequately.

The first pump 110 and the second pump 120 include the elliptical rotors 111, 121, and the reed valves 115, 125, respectively. Because of a low number of components, the first pump 110 and the second pump 120 can be structurally simplified and designed to be compact in size. Thus, the belt cleaner 100 or the laser printer 1 can be prevented from increasing in size, and waste toner can be collected and accommodated reliably.

Generally when a large amount of powder builds up on an outlet side of a pump for feeding powder, the discharge pressure rises and the effectiveness of the pump is reduced.

In this illustrative embodiment, the feeding amount of the second pump 120 per unit time is greater than that of the first pump 110. This setting prevents waste toner from building up in large quantities on the outlet side 110B of the first pump 110, and also can prevent the effectiveness of the first pump 110 from being reduced.

In this illustrative embodiment, the elliptical rotor 121 of the second pump 120 is identical in size with the elliptical rotor 111 of the first pump 110. The first pump 110 and the second pump 120 are provided with the same constituent components, thus preventing an increase in variety of components making up the laser printer 1. Without an increase in the variety of components, the second pump 120 may be installed, preventing the feeding capacity of the first pump 110 from being reduced.

A second illustrative embodiment of the invention will be described with reference to FIG. 3.

In the first illustrative embodiment, the elliptical rotors 111, 121 of the first and second pumps 110, 120 are identical in size, and the rotational speed of the rotor 121 is set greater than that of the rotor 111, so that the feeding capability of the second pump 120 is set higher than that of the first pump 110.

Figure 3:
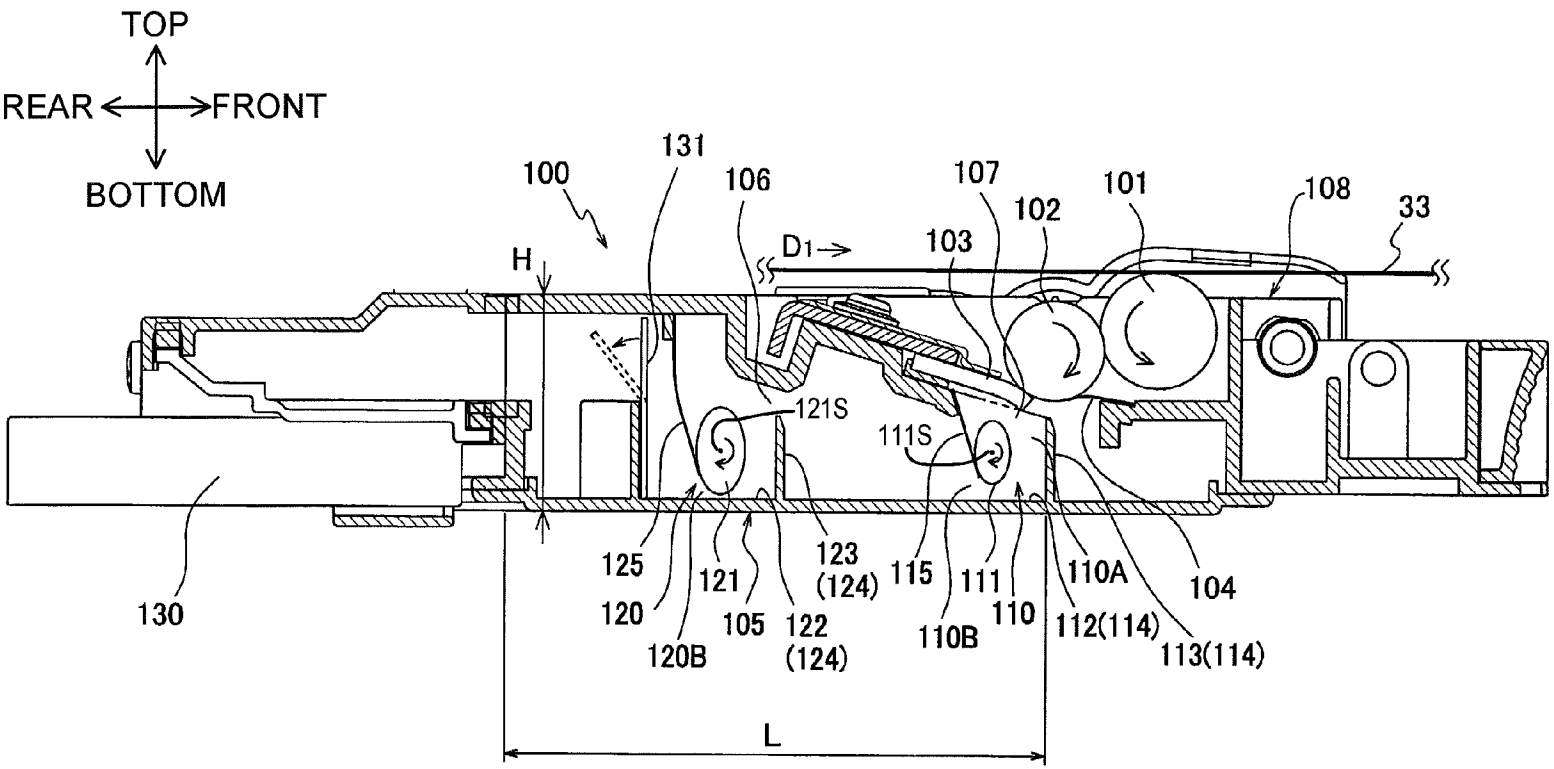
FIG. 3 is an enlarged view of a belt cleaner according to a second illustrative embodiment.

In the second illustrative embodiment, as shown in FIG. 3, the elliptical rotor 121 has a major axis $\phi$1 greater in size than that of the elliptical rotor 111, so that the second pump 120 has a greater feeding capacity than the first pump 110.

A transmission gear ratio from the drive source to the elliptical rotor 111 and a transmission gear ratio from the drive source to the elliptical rotor 121 are set such that the elliptical rotors 111, 121 have the same rotational speed.

A drive shaft 111S of the elliptical rotor 111 and a drive shaft 121S of the elliptical rotor 121 are coupled to the belt so that they rotate at the same speed.

In addition, the elliptical rotor 121 of the second pump 120 may be greater in the minor axis $\phi$2 than the elliptical rotor 111 of the first pump 110.

The above-described pumps for conveying waste toner use the elliptical rotors 111, 121. The invention is not limited to elliptical rotors. Instead of the elliptical rotors, a rolling piston-type pump or a pump using a radial rotor may be used.

The first wall surface 112 and the second wall surface 113 can be connected perpendicularly. The first wall surface 112 and the second wall surface 113 may be connected by a curved surface parallel to a path taken by a vertex of the major axis of the elliptical rotor 111.

The second pump 120 has a feeding capacity greater than the first pump 110. However, the first pump 110 and the second pump 120 may have the same feeding capacity. Alternatively, the second pump 120 may have a feeding capacity smaller than the first pump 110.

When the second pump 120 has a feeding capacity smaller than the first pump 110, waste toner discharged from the first pump 110 may accumulate and function as the wall surface 123 of the rotor housing portion 124. In this case, the wall surface 123 may be eliminated.

The first pump 110 is disposed in the waste toner container 105. However, any arrangement may be accepted as long as the first pump 110 is disposed in vicinity of the toner inlet 107. For example, the first pump 110 may be disposed in vicinity of the toner inlet 107 positioned outside of the waste toner container 105.

The first and second pumps 110, 120 are identical type pumps. However, the first and second pumps 110, 120 may be different type pumps.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form an image on a recording sheet by transferring toner onto the recording sheet, the image forming apparatus comprising:

a first roller;

a second roller spaced apart from the first roller;

a belt looped around the first roller and the second roller, the belt extending in an extending direction between the first roller and the second roller, the belt being configured to rotate;

a container having an inlet configured to receive waste toner from a surface of the belt, the container including a bottom peripheral surface on which the waste toner is to be accumulated and a top peripheral surface opposite the bottom peripheral surface, the container defining a storage area having a horizontal dimension greater than a vertical dimension;

a first pump disposed below the belt and adjacent to the inlet of the container on an inlet side, and being configured to feed the waste toner from the inlet to an outlet side of the first pump, the first pump comprising a first elliptical rotor having an elliptical-shaped cross section, and being configured to rotate on a shaft disposed perpendicular to the cross section;

a second pump disposed below the belt and on the outlet side of the first pump, and being configured to feed the waste toner fed by the first pump to an outlet side of the second pump on a side opposite the inlet in the storage area, the second pump comprising a second elliptical rotor having an elliptical-shaped cross section, and being configured to rotate on a shaft disposed perpendicular to the cross section, the second elliptical rotor being spaced apart from the first elliptical rotor in the extending direction; and a cleaning roller disposed between the belt and the first pump, and being configured to supply the waste toner from the surface of the belt to an inlet side of the first pump opposite the outlet side of the first pump, wherein the container includes a lower wall extending from the bottom peripheral surface of the container toward the belt such that a line connecting axes of the first elliptical rotor and the second elliptical rotor intersects the lower wall, and the lower wall is disposed in the storage area between the outlet side of the first pump and the second pump.

2. The image forming apparatus according to claim 1, further comprising a detector configured to detect whether the waste toner stored in the storage area exceeds a predetermined amount, wherein the detector detects an amount of the waste toner in the storage area on the outlet side of the second pump.

3. The image forming apparatus according to claim 1, wherein the first pump further comprises:

a first reed valve configured to slidably contact an outer surface of the first elliptical rotor, and being configured to prevent waste toner discharged from the outlet side of the first pump from being discharged toward the inlet side of the first pump.

4. The image forming apparatus according to claim 3, wherein the second pump further comprises:

a second reed valve configured to slidably contact an outer surface of the second elliptical rotor, and being configured to prevent waste toner discharged from the outlet side of the second pump from being discharged toward the inlet side of the second pump, and wherein the second pump has a feeding capacity per unit time greater than the first pump.

5. The image forming apparatus according to claim 1, wherein a major axis of the second elliptical rotor is greater in size than a major axis of the first elliptical rotor.

6. The image forming apparatus according to claim 5, further comprising a detector configured to detect whether the waste toner stored in the storage area exceeds a predetermined amount, wherein the detector detects an amount of the waste toner in the storage area on the outlet side of the second pump.

7. The image forming apparatus according to claim 5, wherein the first pump further comprises:

a first reed valve configured to slidably contact an outer surface of the first elliptical rotor, and being configured to prevent waste toner discharged from the outlet side of the first pump from being discharged toward the inlet side of the first pump.

8. The image forming apparatus according to claim 7, wherein the second pump further comprises:

a second reed valve configured to slidably contact an outer surface of the second elliptical rotor, and being configured to prevent waste toner discharged from the outlet side of the second pump from being discharged toward the inlet side of the second pump, and wherein the second pump has a feeding capacity per unit time greater than the first pump.

9. The image forming apparatus according to claim 5, wherein the second elliptical rotor is disposed closer to the bottom peripheral surface than to the top peripheral surface.

10. The image forming apparatus according to claim 5, wherein the lower wall is disposed closer to the second elliptical rotor than to the first elliptical rotor.

11. The image forming apparatus according to claim 5, wherein the container comprises an upper wall surface facing a lower wall surface and including a portion of the top peripheral surface closest to the lower wall surface, and wherein the first pump is configured to feed the waste toner to pass through a space between the lower wall and the upper wall to the second pump.

12. The image forming apparatus according to claim 1, wherein the second pump is configured to have a greater feeding capacity per unit time than the first pump.

13. The image forming apparatus according to claim 12, wherein the container comprises an upper wall facing the lower wall and including a portion of the top peripheral surface closest to a lower wall surface, and wherein the first pump is configured to feed the waste toner to pass through a space between the lower wall and the upper wall to the second pump.

14. The image forming apparatus according to claim 1, wherein the second elliptical rotor is identical in size to the first elliptical rotor, and a rotational speed of the second elliptical rotor per unit time is greater than a rotational speed of the first elliptical rotor per unit time.

15. The image forming apparatus according to claim 1, wherein the second elliptical rotor is disposed closer to the bottom peripheral surface than to the top peripheral surface.

16. The image forming apparatus according to claim 1, further comprising a film door disposed closer to the outlet side of the second pump than to an inlet side of the second pump to form a compartment, the film door being configured to move between an opening position and a closing position, wherein the film door is configured to move to the opening position when pressure of the waste toner accumulated on the outlet side of the second pump reaches a predetermined amount.

17. The image forming apparatus according to claim 16, wherein the film door is configured to prevent the waste toner accumulated on the outlet side of the second pump from moving to the compartment when the film door is in the closing position, and to allow the toner accumulated on the compartment to move to the inlet side of the second pump when the film door is in the opening position.

18. The image forming apparatus according to claim 1, wherein the cleaning roller is configured to rotate such that the cleaning roller removes the waste toner from the belt, the image forming apparatus further comprising a shaft configured to rotate and contact the cleaning roller such that the shaft removes the waste toner from the cleaning roller.

19. An image forming apparatus configured to form an image on a recording sheet by transferring toner onto the recording sheet, the image forming apparatus comprising a first roller;

a second roller spaced apart from the first roller;

a belt looped around the first roller and the second roller, the belt extending in an extending direction between the first roller and the second roller, the belt being configured to rotate;

a container having an inlet configured to receive waste toner from a surface of the belt, the container including a bottom peripheral surface on which the waste toner is to be accumulated and a top peripheral surface opposite the bottom peripheral surface, the container defining a storage area having a horizontal dimension greater than a vertical dimension;

a first pump disposed below the belt and adjacent to the inlet of the container on an inlet side, and being configured to feed the waste toner from the inlet to an outlet side of the first pump, the first pump comprising a first elliptical rotor having an elliptical-shaped cross section, and being configured to rotate on a shaft disposed perpendicular to the cross section; and a second pump disposed below the belt and on the outlet side of the first pump, and being configured to feed the waste toner fed by the first pump to an outlet side of the second pump on a side opposite the inlet in the storage area, the second pump comprising a second elliptical rotor having an elliptical-shaped cross section, and being configured to rotate on a shaft disposed perpendicular to the cross section, the second elliptical rotor being spaced apart from the first elliptical rotor in the extending direction, wherein the container includes a lower wall extending from the bottom peripheral surface of the container toward the belt such that a line connecting axes of the first elliptical rotor and the second elliptical rotor intersects the lower wall, and the lower wall is disposed in the storage area between the outlet side of the first pump and the second pump, and wherein the lower wall is disposed closer to the second elliptical rotor than to the first elliptical rotor.

20. An image forming apparatus configured to form an image on a recording sheet by transferring toner onto the recording sheet, the image forming apparatus comprising:

a first roller;

a second roller spaced apart from the first roller;

a belt looped around the first roller and the second roller, the belt extending in an extending direction between the first roller and the second roller, the belt being configured to rotate;

a container having an inlet configured to receive waste toner from a surface of the belt, the container including a bottom peripheral surface on which the waste toner is to be accumulated and a top peripheral surface opposite the bottom peripheral surface, the container defining a storage area having a horizontal dimension greater than a vertical dimension;

a first pump disposed below the belt and adjacent to the inlet of the container on an inlet side, and being configured to feed the waste toner from the inlet to an outlet side of the first pump, the first pump comprising a first elliptical rotor having an elliptical-shaped cross section, and being configured to rotate on a shaft disposed perpendicular to the cross section; and configured to form an image on a recording sheet by transferring toner onto the recording sheet; and a second pump disposed below the belt and on the outlet side of the first pump, and being configured to feed the waste toner fed by the first pump to an outlet side of the second pump on a side opposite the inlet in the storage area, the second pump comprising a second elliptical rotor having an elliptical-shaped cross section, and being configured to rotate on a shaft disposed perpendicular to the cross section, the second elliptical rotor being spaced apart from the first elliptical rotor in the extending direction;

wherein the container includes a lower wall extending from the bottom peripheral surface of the container toward the belt such that a line connecting axes of the first elliptical rotor and the second elliptical rotor intersects the lower wall, and the lower wall is disposed in the storage area between the outlet side of the first pump and the second pump, wherein the container comprises an upper wall facing the lower wall and including a portion of the top peripheral surface closest to the lower wall, and wherein the first pump is configured to feed the waste toner to pass through a space between the lower wall and the upper wall to the second pump.

* * * * *